US010640953B2

(12) United States Patent
Thomsen et al.

(10) Patent No.: US 10,640,953 B2
(45) Date of Patent: May 5, 2020

(54) SYSTEM AND METHOD FOR WORK TOOL RECOGNITION

(71) Applicant: Caterpillar Inc., Peoria, IL (US)

(72) Inventors: Anders Christian Thomsen, Dubai (AE); Sébastien Jean-Paul Thiery, Geneva (CH)

(73) Assignee: Caterpillar Inc., Peoria, IL (US)

( * ) Notice: Subject to any disclaimer, the term of this patent is extended or adjusted under 35 U.S.C. 154(b) by 372 days.

(21) Appl. No.: 15/654,987

(22) Filed: Jul. 20, 2017

(65) Prior Publication Data

US 2019/0024345 A1 Jan. 24, 2019

(51) Int. Cl.
*E02F 9/26* (2006.01)
*E02F 3/36* (2006.01)

(52) U.S. Cl.
CPC ..... *E02F 9/264* (2013.01); *E02F 3/3604* (2013.01)

(58) Field of Classification Search
None
See application file for complete search history.

(56) References Cited

U.S. PATENT DOCUMENTS

2008/0187421 A1* 8/2008 Givens ..... B25J 9/042 414/225.01
2009/0136293 A1 5/2009 Normann
2014/0178164 A1* 6/2014 Peterson ..... E02F 3/432 414/685

FOREIGN PATENT DOCUMENTS

DE 3043602 A1 * 6/1982 ..... A01B 63/1117
JP 64058444 8/1987

OTHER PUBLICATIONS

English machine translation of German-language patent document Arnold (DE-3043602-A1) (Year: 1982).*

* cited by examiner

*Primary Examiner* — David M. Gray
*Assistant Examiner* — Geoffrey T Evans
(74) *Attorney, Agent, or Firm* — Leydig, Voit & Mayer, Ltd.

(57) ABSTRACT

A machine is provided. The machine includes an engine, a work tool attached to the machine, and a work tool recognition system for the machine. The work tool recognition system includes a sensor associated with the work tool. The sensor is configured to generate a signal indicative of a weight of the work tool. The work tool recognition system includes a controller coupled to the sensor. The controller is configured to receive the signal indicative of the weight of the work tool. The controller is configured to monitor the weight of the work tool along a predefined path. The controller is configured to compare the monitored and the received weights associated with the work tool with a predefined dataset. The controller is configured to identify a type of the work tool based on the comparison.

19 Claims, 3 Drawing Sheets

SYSTEM AND METHOD FOR WORK TOOL RECOGNITION

TECHNICAL FIELD

The present disclosure relates to a work tool of a machine and more particularly to a system and method for recognizing the work tool attached to the machine.

BACKGROUND

Machines, such as excavators, have work tools installed thereon to perform a variety of operations at a work site. Different types of the work tools may be attached to the machine based on the type of operation to be performed at the work site. The operation of the work tool and a method of operating the work tool may vary based on the type of the work tool that is currently attached to the machine.

In case of autonomous or semi-autonomous operation of the machine, the system may initially need to identify the type of the work tool that is currently attached to the machine to perform further activities using the work tool. Currently the type of the work tool may be selected by the operator. This may put stress on the operator to ensure that the operator always remembers to change the type of a work tool selection on changing the work tool and make the right selection while informing the system. Further, incorrectly identifying the type of the work tool may lead to over or under loading of the system, undesired operations being performed, damage to some parts of the machine, undesired re-work at the worksite, and so on. Known solutions may be a tedious and time-consuming process, affecting an overall productivity and efficiency of the system.

United States Published Application Number 2009/0136293 describes a coupler for a machine. The coupler includes a housing sized to matingly engage a corresponding coupler housing. An electrical connector, disposed within the coupler housing is configured to create an electrical connection between the tool and the machine at a communication node. The electrical connection provides a circuit pathway for a conductor delivering both power and data to a plurality of devices connected to the machine. A message containing tool identification information is transmitted from the communication node when the coupler housing is connected to the complimentary coupler housing.

SUMMARY OF THE DISCLOSURE

In one aspect of the present disclosure, a machine is provided. The machine includes an engine, a work tool attached to the machine, and a work tool recognition system for the machine. The work tool recognition system includes a sensor associated with the work tool. The sensor is configured to generate a signal indicative of a weight of the work tool. The work tool recognition system includes a controller coupled to the sensor. The controller is configured to receive the signal indicative of the weight of the work tool. The controller is configured to monitor the weight of the work tool along a predefined path. The controller is configured to compare the monitored and the received weights associated with the work tool with a predefmed dataset. The controller is configured to identify a type of the work tool based on the comparison.

In another aspect of the present disclosure, a method for recognition of a work tool of a machine is provided. The method includes receiving, by a controller, a signal indicative of a weight of the work tool. The method includes monitoring, by the controller, the weight of the work tool along a predefined path. The method includes comparing, by the controller, the monitored and the received weights associated with the work tool with a predefmed dataset. The method includes identifying, by the controller, a type of the work tool based on the comparison.

In another aspect of the present disclosure, a work tool recognition system for a machine is provided. The work tool recognition system includes a sensor associated with a work tool of the machine. The sensor is configured to generate a signal indicative of a weight of the work tool. The work tool recognition system includes a controller coupled to the sensor. The controller is configured to receive the signal indicative of the weight of the work tool. The controller is configured to monitor the weight of the work tool along a predefined path. The controller is configured to compare the monitored and the received weights associated with the work tool with a predefined dataset. The controller is configured to identify a type of the work tool based on the comparison.

Other features and aspects of this disclosure will be apparent from the following description and the accompanying drawings.

DETAILED DESCRIPTION

Wherever possible, the same reference numbers will be used throughout the drawings to refer to the same or the like parts. Also, corresponding or similar reference numbers will be used throughout the drawings to refer to the same or corresponding parts.

Figure 1:
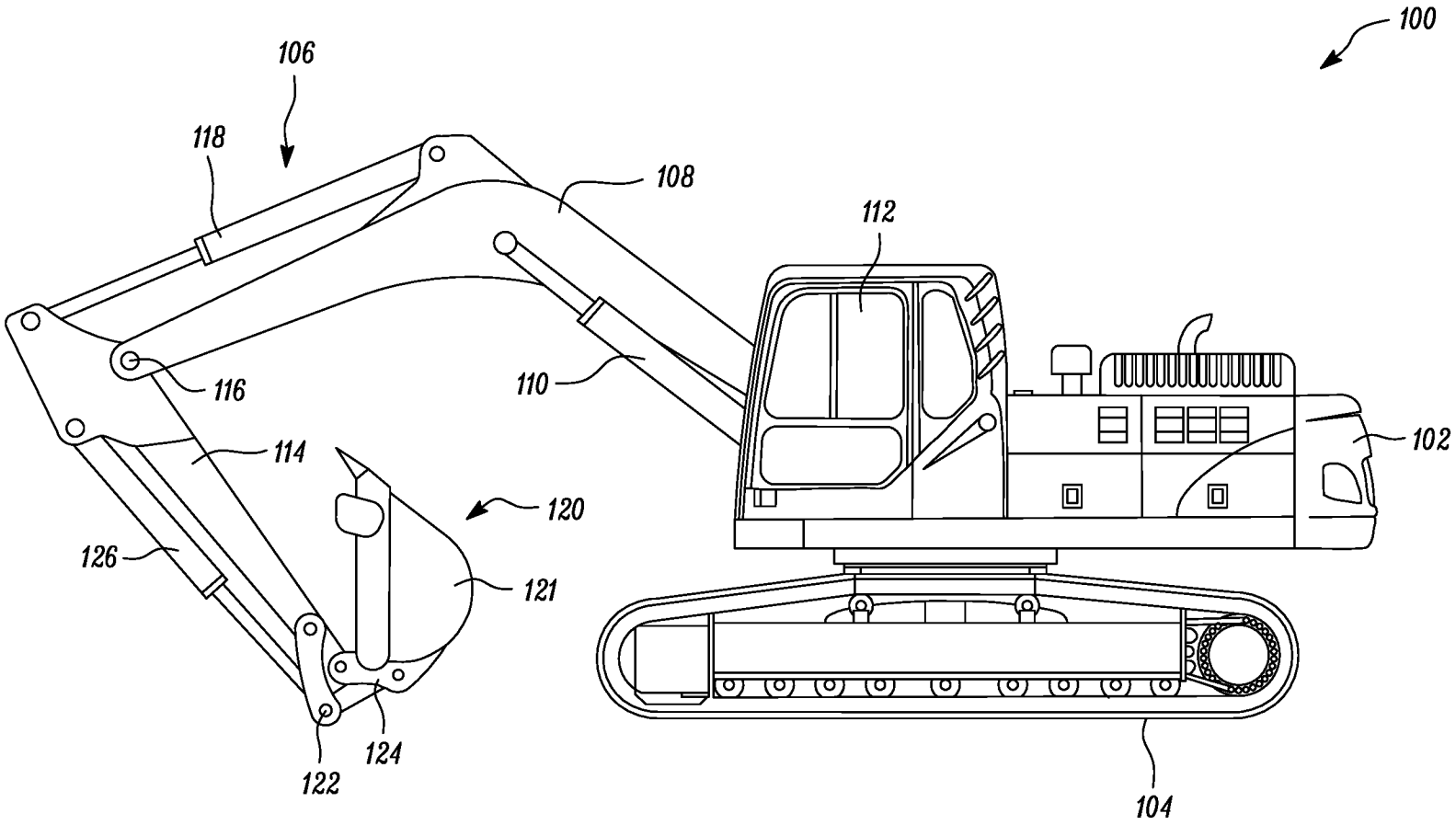
FIG. 1 is a side view of an exemplary machine, according to various concepts of the present disclosure.

FIG. 1 illustrates an exemplary machine 100. The machine 100 is embodied as an excavator. It should be noted that the machine 100 may include other industrial machines such as a backhoe loader, shovel, a tractor, or any other construction machines that are known in the art, and more specifically machines that make use of a work tool. As shown in FIG.1, the machine 100 includes a body 102 that is rotatably mounted on tracks 104.

The machine 100 includes a linkage member 106 such as a boom 108 which is pivotally mounted on the body 102. The boom 108 extends outwards. Hydraulic cylinders 110, controlled by an operator sitting in an operator cab 112 or by a machine control system, move the boom 108 relative to the body 102 during operation. Also, a stick 114 is pivotally mounted at a pivot point 116 to an outer end of the boom 108. Similarly, a hydraulic cylinder 118 may be used to move the stick 114 relative to the boom 108 about the pivot point 116 during excavation.

A work tool 120 is pivotally mounted at a pivot point 122 to an outer end of the stick 114 by a quick coupler 124. The work tool 120 is embodied as a bucket 121. A hydraulic cylinder 126 moves the bucket 121 relative to the stick 114 about the pivot 122 during the operation. Alternatively, the work tool 120 may be a ripper, a hammer, a bucket of another size, a crusher, a shear, or any other known attachment or tool for the machine 100. For the purpose of this disclosure, the linkage members 106, that is the boom 108 and the stick 114 together with the work tool 120 form the implement of the machine 100. The quick coupler 124 may be hydraulically or electrically activated. To change the work tool 120 that is attached to the machine 100, the quick coupler 124 is opened, the existing work tool 120 that is attached to the machine 100 is removed, a new work tool 120 is attached, and the quick coupler 124 is closed.

Figure 2:
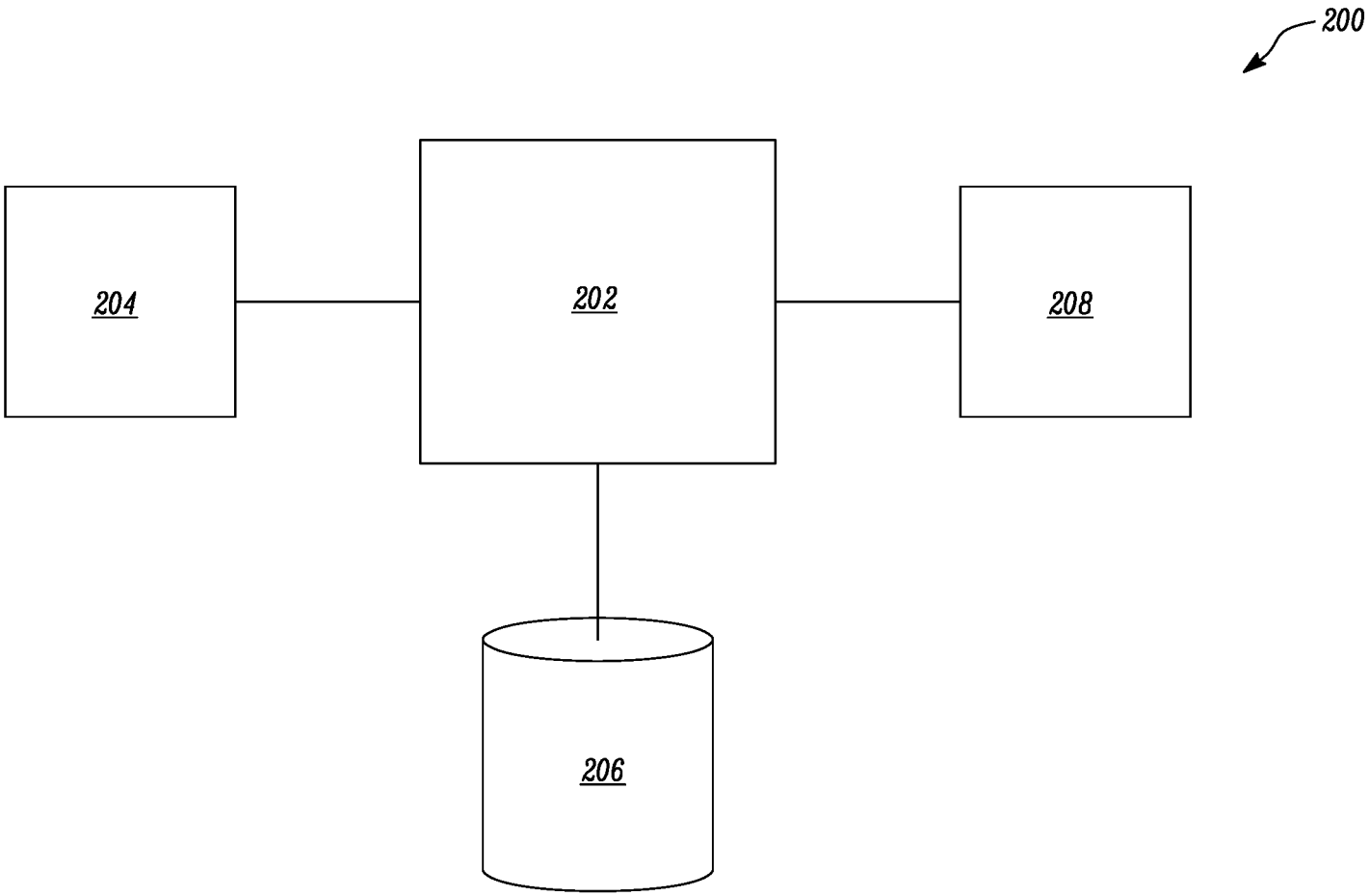
FIG. 2 is a block diagram of a work tool recognition system associated with the machine of FIG. 1, according to various concepts of the present disclosure.

The present disclosure relates to a work tool recognition system 200 (see FIG. 2) for the machine 100. The work tool recognition system 200 includes a controller 202. The controller 202 is coupled to a sensor 204. The sensor 204 may be present on-board the machine 100. The sensor 204 is configured to generate a signal indicative of a weight of the work tool 120 currently attached to the machine 100. The sensor 204 includes a pressure sensor and is configured to generate a pressure sensor reading of a pressure in the hydraulic cylinders 110, 118, 126 of the linkage members 106 indicative of the weight of the work tool 120 that is attached to the machine 100. Further, the controller 202 may receive signals from an implement position sensor (not shown) and/or an angle sensor (not shown) of the machine 100 indicating the position and angle of the linkage member 106 to which the work tool 120 is attached. The implement position sensor and/or angle sensor is configured to generate a signal indicative of a current position of the implement of the machine 100. The controller 202 may then correlate the pressure, position and/or angle readings and compare with pre-calibrated readings to determine the weight of the work tool 120 based on the received signals.

The controller 202 is configured to monitor and record weights of the work tool 120 along a predefmed path of movement. The predefined path of movement may be pre-calibrated in the system. As the work tool 120 moves along the predefined path, the controller 202 may receive a set of readings of different weights of the work tool 120 for different positions of the work tool 120 recorded along the predefmed path.

In some embodiments, the controller 202 is configured to receive a signal indicative of a state of the quick coupler 124 and/or a change in the state of the quick coupler 124. For example, to attach the work tool 120 to the machine 100, the state of the quick coupler 124 changes from a closed state to an open state. Thereafter, the quick coupler 124 is restored to the closed state.

In yet another embodiment, the controller 202 may be coupled to position detection sensor (not shown) associated with the machine 100. The position detection senor may include a Global Positioning System (GPS), a LIDAR system, a LADAR system, a perception based sensor system, or any other known system for detecting a position of the machine 100. The controller 202 may receive signals from the position detection sensor and may determine if there is a change in the position of the machine 100 based on the received signals. Further, in some cases, based on signals received from the implement position sensor, the controller 202 may determine if there is a change in the position of the implement indicating a possibility of the change in the work tool 120 of the machine 100.

For example, if the controller 202 determines that there is displacement in the position of the machine 100, the controller 202 may assume that the displacement may be to lift or pick-up another work tool 120 from a new location for changing the work tool 120 that is currently attached to the machine 100. In another example, the controller 202 may determine that a swing action of the implement of the machine 100 is indicative of a possibility that the movement may be for changing the work tool 120 of the machine 100. Based on the signals indicative of the change in the state of the quick coupler 124 and the change in the position of the machine 100 and/or the implement, the controller 202 may determine that the work tool 120 may have been changed. In such a case, the controller 202 may trigger or activate the control logic for determining the type of the work tool 120 as will be described in this section.

The controller 202 is coupled to a database 206. The database 206 is a known data storage system or data repository. The database 206 may be present on the machine 100 or at a remote location. The database 206 includes any known data storage medium for storage of information that may be accessed when required by the controller 202. The database 206 stores a predefined dataset containing information related to weights of different types of the work tool 120 corresponding to different positions of the work tool 120. The weights of the different types of the work tool 120 may be determined by the controller 202 based on the correlation of the pressure reading of the pressure in the hydraulic cylinders 110, 118, 126, and the readings of the position and/or angle of the linkage member 106.

While calibrating the system, the operator may enter dimensions of the different types of the work tool 120 and may also perform a series of calibration steps to allow the system to understand the weight of the implement, that is the work tool 120 along with the boom 108 and stick 114 in various positions. The system may further enhance the algorithm and then perform the calibration steps with only the quick coupler 124 and no work tool 120, so that the system can determine the weight of the quick coupler 124, the boom 108 and the stick 114 in the various positions based on the pressure in the hyrdraulic cylinders 110, 118, 126, as well as the position and/or angle sensor readings associated with the linkage member 106. Using this data, the system may populate and record the weight of the different types of the work tools 120 corersponding to the various positions and store this information in the database 206.

The controller 202 retrieves the data from the database 206 and compares the data related to the weight of the work tool 120 at different positions with the readings from the sensor 204 and the implement position sensor. The controller 202 correlates the data from the predefined dataset with the real-time readings of the work tool 120 that is currently attached to the machine 100. The weight of the work tool 120 recorded at different positions is specific to the type of the work tool 120. The controller 202 is configured to identify the type of the work tool 120 currently attached to the machine 100 based on the comparison with the predefined dataset. In some cases, two different types of the work tool 120 may have the same weight reading. However, the weight distribution for each type of the work tool 120, that is represented by the weight recorded at the different positions, will be distinct, allowing the controller 202 to easily identify the correct type of the work tool 120 that is currently attached to the machine 100.

The controller 202 is coupled to a display device 208. The display device 208 may include a screen, a touch screen, a monitor, or any other known display unit. The display device 208 is configured to provide a notification of the type of work tool 120 identified by the system. In one example, the display device 208 provides the notification of the type of the work tool 120 identified by the system. The system may ask the operator to verify if the identification of the type of the work tool 120 is correct. The system may accept an input from the operator through an input unit (not shown), for example the touch screen or control panel to validate that the system has correctly identified the type of the work tool 120 attached to the machine 100. In other embodiments, the controller 202 may be coupled to an electronic control module (ECM) present on the machine 100. Based on the type of the work tool 120 identified by the system, the controller 202 may generate a control signal indicative of operations to be performed by the work tool 120. Accordingly, the work tool 120 may be autonomously operated by the machine 100 based on prestored data for operating the given type of the work tool 120.

The controller 202 may be a microprocessor or other processor as known in the art. The controller 202 may embody a single microprocessor or multiple microprocessors for receiving signals from components of the engine system 100. Numerous commercially available microprocessors may be configured to perform the functions of the controller 202. A person of ordinary skill in the art will appreciate that the controller 202 may additionally include other components and may also perform other functions not described herein.

INDUSTRIAL APPLICABILITY

Figure 3:
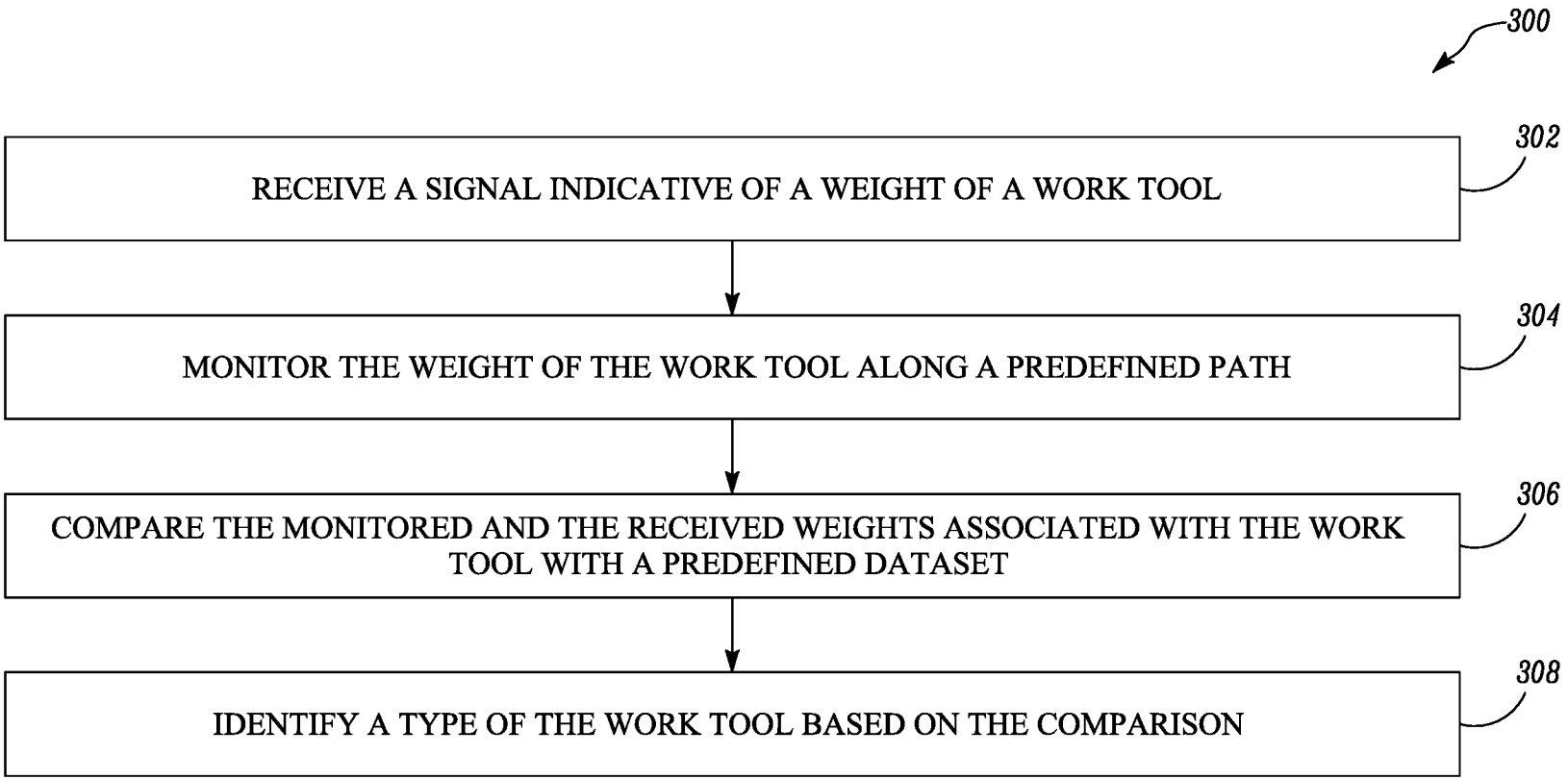
FIG. 3 is a flowchart of a method for recognition of a work tool of the machine, according to various concepts of the present disclosure.

The present disclosure relates to a system and method for recognizing a type of the work tool 120 attached to the machine 100. FIG. 3 illustrates a flowchart of a method for recognizing the work tool 120. At step 302, the controller 202 receives the signal indicative of the weight of the work tool 120. At step 304, the controller 202 monitors the weight of the work tool 120 along the predefined path. At step 306, the controller 202 compares the monitored and the received weights associated with the work tool 120 with the predefined dataset. At step 308, the controller 202 identifies the type of the work tool 120 attached to the machine 100 based on the comparison.

The system offers a cost-effective and robust solution for identifying the type of the work tool 120 that is attached to the machine 100. The system puts less stress on the operator and effectively identifies the work tool 120 every time that the work tool 120 on the machine 100 is changed. The system can distinguish between two work tools 120 that are of different types but may have the same weight based on multiple weight readings associated with different positions of the work tool 120, which is unique to the type of the work tool 120. Further, in systems that make use of contactless sensors or other types of wireless technology sensors for identifying the type of the work tool 120, the system and method described herein may serve as a check to ensure that the type of the work tool 120 has been identified correctly by such systems.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A machine comprising:

an engine;

a work tool attached to the machine; and a work tool recognition system for the machine, the work tool recognition system comprising:

a sensor associated with the work tool, the sensor configured to generate a signal indicative of a weight of the work tool; and a controller coupled to the sensor, the controller configured to:

receive the signal indicative of the weight of the work tool;

monitor the weight of the work tool along a predefined path to receive a plurality of signals indicative of different weights of the work tool at different locations along the predefined path;

compare the monitored and the received weights associated with the work tool with a predefined dataset including a plurality of readings corresponding to the pre-calibrated weights of the work tool at the different positions along the predefined path; and identify a type of the work tool based on the comparison.

2. The machine of claim 1, wherein the sensor is a pressure sensor associated with cylinders of the work tool.

3. The machine of claim 1, wherein the controller is further configured to receive a signal indicative of a state of a quick coupler associated with the work tool.

4. The machine of claim 1, wherein the controller is coupled to an implement position sensor, the implement position sensor configured to generate a signal indicative of a current position of an implement of the machine.

5. The machine of claim 4, wherein the controller is configured to determine if the work tool has been changed based on the current position of the implement and a position of the machine.

6. The machine of claim 1, wherein the controller is coupled to a display device, and wherein the controller is configured to display a notification of the type of the work tool.

7. The machine of claim 1, wherein the controller is coupled to a control module of the work tool, and wherein the controller is configured to generate a control signal indicative of operations to be performed by the work tool based on the identification.

8. A method for recognition of a work tool of a machine, the method comprising:

receiving, by a controller, a signal indicative of a weight of the work tool;

monitoring, by the controller, the weight of the work tool along a predefined path to receive a plurality of signals indicative of different weights of the work tool at different locations along the predefined path;

comparing, by the controller, the monitored and the received weights associated with the work tool with a predefined dataset including a plurality of readings corresponding to the pre-calibrated weights of the work tool at the different positions along the predefined path; and identifying, by the controller, a type of the work tool based on the comparison.

9. The method of claim 8 further comprising receiving, by the controller, a signal indicative of a state of a quick coupler associated with the work tool.

10. The method of claim 8 further comprising receiving, by the controller, a signal indicative of a current position of an implement of the machine.

11. The method of claim 10 further comprising determining, by the controller, if the work tool has been changed based on the current position of the implement and a position of the machine.

12. The method of claim 8 further comprising displaying, by the controller, a notification of the type of the work tool.

13. The method of claim 8 further comprising generating, by the controller, a control signal indicative of operations to be performed by the work tool based on the identification.

14. A work tool recognition system for a machine, the work tool recognition system comprising:

a sensor associated with a work tool of the machine, the sensor configured to generate a signal indicative of a weight of the work tool; and a controller coupled to the sensor, the controller configured to:

receive the signal indicative of the weight of the work tool;

monitor the weight of the work tool along a predefined path to receive a plurality of signals indicative of different weights of the work tool at different positions along the predefined path;

compare the monitored and the received weights associated with the work tool with a predefined dataset including a plurality of readings corresponding to the pre-calibrated weights of the work tool at the different positions along the predefined path; and identify a type of the work tool based on the comparison.

15. The work tool recognition system of claim 14, wherein the controller is further configured to receive a signal indicative of a state of a quick coupler associated with the work tool.

16. The work tool recognition system of claim 14, wherein the controller is coupled to an implement position sensor, the implement position sensor configured to generate a signal indicative of a current position of an implement of the machine.

17. The work tool recognition system of claim 16, wherein the controller is configured to determine if the work tool has been changed based on the current position of the implement and a position of the machine.

18. The work tool recognition system of claim 14, wherein the controller is coupled to a display device, and wherein the controller is configured to display a notification of the type of the work tool.

19. The work tool recognition system of claim 14, wherein the controller is coupled to a control module of the work tool, and wherein the controller is configured to generate a control signal indicative of operations to be performed by the work tool based on the identification.

* * * * *